US009386871B2

(12) United States Patent
Domit

(10) Patent No.: US 9,386,871 B2
(45) Date of Patent: Jul. 12, 2016

(54) MULTI-FLAP BOX FOR SODA STRAWS

(71) Applicant: Antonio Domit, Mexico City (MX)

(72) Inventor: Antonio Domit, Mexico City (MX)

( * ) Notice: Subject to any disclaimer, the term of this patent is extended or adjusted under 35 U.S.C. 154(b) by 0 days.

(21) Appl. No.: 14/477,097

(22) Filed: Sep. 4, 2014

(65) Prior Publication Data

US 2015/0060534 A1 Mar. 5, 2015

Related U.S. Application Data

(60) Provisional application No. 61/959,913, filed on Sep. 5, 2013, provisional application No. 61/998,811, filed on Jul. 7, 2014.

(51) Int. Cl.

| | |
|---|---|
| ***A47F 1/08*** | (2006.01) |
| ***B65D 5/72*** | (2006.01) |
| ***B65D 83/02*** | (2006.01) |
| ***A47G 19/30*** | (2006.01) |

(52) U.S. Cl.

CPC ..... *A47G 21/184* (2013.01); *A47F 1/08* (2013.01); *B65D 5/724* (2013.01); *B65D 5/726* (2013.01); *B65D 83/02* (2013.01); *Y10T 29/49826* (2015.01)

(58) Field of Classification Search

CPC ..... A47G 21/184; B65D 83/02; B65D 2583/005; B65D 5/724; B65D 5/726; B65D 71/36; A47F 1/08; A47F 1/087

See application file for complete search history.

(56) References Cited

U.S. PATENT DOCUMENTS

| | | | | | |
|---|---|---|---|---|---|
| 1,662,831 | A | | 3/1928 | McCarthy | |
| 1,753,957 | A | | 4/1930 | Washburn | |
| 1,794,632 | A | * | 3/1931 | Luckett | B65D 5/724 206/268 |
| 2,294,979 | A | * | 9/1942 | Goldberg | B65D 5/725 221/196 |
| 3,556,344 | A | | 1/1971 | Leon et al. | |
| 3,773,245 | A | * | 11/1973 | Meyers | B65D 5/723 206/264 |
| 3,960,299 | A | | 6/1976 | Hollinger | |
| 4,227,626 | A | | 10/1980 | Merila | |
| 4,489,854 | A | | 12/1984 | Wenkman et al. | |
| 4,664,291 | A | * | 5/1987 | Gunderson | B65D 83/02 221/309 |
| D329,465 | S | | 9/1992 | Kastanek | |
| D342,647 | S | | 12/1993 | Kastanek | |
| 5,638,988 | A | * | 6/1997 | Rogers | B65B 69/0008 141/330 |
| 5,730,318 | A | * | 3/1998 | Schramm | A24C 5/356 221/197 |
| 5,743,430 | A | | 4/1998 | Freixas | |
| 5,779,049 | A | * | 7/1998 | Werby | B65D 5/326 206/449 |

(Continued)

FOREIGN PATENT DOCUMENTS

| | | |
|---|---|---|
| GB | 508427 | 6/1939 |

*Primary Examiner* — Gary Elkins

(74) *Attorney, Agent, or Firm* — Roger N. Chauza, PC

(57) ABSTRACT

A soda straw box is installed in a dispenser by pushing the box full of straws into the dispenser receptacle. An opening member in the dispenser has a slot into which a corner of the box is pushed so that the corner panels fold together. One corner panel of the straw box is an anchor flap that folds as it is pushed into the opening slot. One or two other flaps are hinged either directly or indirectly to an edge of the anchor flap to assist in forming an opening in the box to allow the straws to fall down into the dispenser. The flaps of the box are all hinged for movement into the box during the opening process.

20 Claims, 10 Drawing Sheets

(56) References Cited

U.S. PATENT DOCUMENTS

| | | | | |
|---|---|---|---|---|
| 5,960,988 | A | 10/1999 | Freixas | |
| 6,663,100 | B2 * | 12/2003 | Crowley | B65H 1/26 206/499 |
| 6,832,542 | B2 * | 12/2004 | Hu | A47J 31/0668 99/295 |
| 8,960,495 | B2 * | 2/2015 | Domit | B65D 83/02 221/203 |
| 2002/0033570 | A1 | 3/2002 | Crowley | |
| 2004/0144796 | A1 | 7/2004 | Wang et al. | |
| 2005/0269343 | A1 | 12/2005 | Gao et al. | |
| 2012/0211522 | A1 | 8/2012 | Gelardi et al. | |
| 2012/0279893 | A1 | 11/2012 | Gelardi et al. | |
| 2012/0298683 | A1 | 11/2012 | Domit | |

* cited by examiner

MULTI-FLAP BOX FOR SODA STRAWS

RELATED APPLICATIONS

This non-provisional patent application claims the benefit of 1) pending U.S. provisional patent application No. 61/959,913, filed Sep. 5, 2013; and 2) pending U.S. provisional patent application No. 61/998,811 filed Jul. 7, 2014.

TECHNICAL FIELD OF THE INVENTION

The present invention relates in general to product packaging, and more particularly to the packaging of soda straws.

BACKGROUND OF THE INVENTION

The fast food business is one of the fastest growing industries in the United States, as well as the world. In the United States alone, there are presently over 200,000 fast food restaurants serving over 50 million patrons daily. The fast food industry makes over $120 billion in sales annually, and the revenues increase each year.

Drinks from soda fountains have the highest profit margins in the fast food industry, as compared to can or bottled drinks Soda fountain drinks are usually provided to patrons by way of a soda fountain where a desired amount of ice is first dispensed in a cup, and then a selected flavor of soda is also dispensed into the cup. Lastly, the patron obtains a soda straw from a dispenser of various types, and places the same in the cup to enjoy the drink with the fast food. As can be appreciated, there are millions of soda straws dispensed to users every day.

One concern in the fast food industry is the sanitary measures that must be taken in order to prevent germs and other disease carrying agents from being passed from either the food preparers or from the patrons themselves to other patrons of the fast food restaurant. Soda straws constitute one medium in which germs can be passed to patrons who use the soda straw dispensers. Many dispensers of soda straws simply constitute a container where plastic sleeve covered straws are made available, and the patron or consumer selects a straw and picks it out of the inventory of straws. This is the simplest type of dispenser, but the straws are usually covered with a plastic sleeve which protects the individual straws from germs that may be carried by the patrons. Because the straws involve an additional process of covering them with the protective sleeves, such straws are more expensive. Additionally, users can grab a number of straws and use only a few, thereby resulting in the waste of soda straws. Other dispensers are more costly, but allow uncovered straws to be dispensed to thereby reduce the waste of straws. But, in this instance, users can touch the straws made available, in that a number of straws can be dispensed and made available to the user without the user taking all of the straws. This presents the opportunity to allow germs to pass from one patron who touches many of the available straws but takes only one straw from the dispenser. The next patron who takes an available straw left over by the previous patron may come into contact with germs left on the available straws. With millions of straws dispensed daily, it can be appreciated that there is an opportunity to communicate germs from straws to many patrons.

In addition to the foregoing, when the straws are not sheathed with a protective cover, employees of the restaurant must periodically fill the dispenser with the unsheathed straws. Unless the employees are very careful in washing their hands or otherwise disinfecting their hands, they have an opportunity to pass germs to the straws as they are withdrawn from the box and placed into the dispenser.

From the foregoing, it can be seen that there is a need for an improved technique to dispense soda straws to users, while substantially reducing the possibility of passing germs from one person to another via the dispensing of the straws. Another need exists for a method of packaging unsheathed straws so that the only person touching the individual straw is the person who wishes to dispense a straw and use the same. To that end, the straws can be boxed at a manufacturing plant without the straws being touched by any person, the straws can be placed with the box in the dispenser without any person touching the straws, and each straw is dispensed to a user who wants a straw, and multiple straws cannot be dispensed without each straw being taken by a user. In other words, if a straw is made available to a user and not taken, then another straw cannot be made available until that one is taken.

SUMMARY OF THE INVENTION

In accordance with a feature of the invention, disclosed is a dispenser that is loaded with a closed box full of straws, and the dispenser dispenses the straws to the users on a one-by-one basis. Unless the available straw is taken by a user, another straw cannot be dispensed.

Another feature of the invention is that the box contains unsheathed straws, thereby making the manufacture of straws more cost effective. Another aspect is that the straws do not need to be transferred from the box to the dispenser, but rather the box is opened automatically when pushed into the dispenser receptacle.

A further feature of the invention is that the box of straws is opened by dispenser apparatus moving a flap structure inside the box to provide an opening in the box through which the straws can fall into the dispenser and be individualized and then dispensed. The flap structure of the straw box can include multiple flaps, including an anchor flap hinged to the box, and a support flap hinged to the anchor flap, where the support flap slides up inside the box and prevents straws from being lodged behind the flap structure as it is moved inside the straw box during the opening process.

According to another feature of the invention, a straw box has a bottom opening covered by an anchor flap that is hinged at a corner of the box. The straw dispenser is loaded with a full box of straws in a manner where the unopened box is pushed into the dispenser receptacle, and as the box is pushed into the receptacle, a folding member attached at the bottom of the dispenser receptacle forces a corner of the bottom of the box to be folded, whereby the anchor flap is folded up inside the straw box. The support flap causes the straws to be moved out of the way so that the flap structure can be moved entirely inside the box, whereby an opening is formed in the bottom of the box for allowing straws to fall down into the dispenser.

With regard to a further feature of the invention, the top of the support flap can be equipped with tabs that protrude through respective slots in the box, thereby guiding the top of the support flap along the inside surface of the front panel of the box. The straws inside the box do not thereby interfere with the opening of the box by moving the flap structure inside the box.

According to an embodiment of the invention, disclosed is a soda straw box that includes a box for holding a plurality of soda straws. The box includes a flap structure that is adapted for covering an opening in a bottom of the box, and when the box is pushed into a receptacle of a straw dispenser, the flap structure is moved into the box to an opened position to allow straws to move from the box to the dispenser.

According to another embodiment of the invention, disclosed is a soda straw box for holding a plurality of soda straws. A flap structure is adapted for covering at least a portion of an opening in a bottom of the box. The flap structure includes an anchor flap hinged at an edge of a panel of said box, and a support flap hinged at one edge thereof to the flap structure. The box is opened by moving the anchor flap and the support flap inside the box.

A further embodiment is a method of constructing a box for holding soda straws, which includes assembling six panels to construct a six-sided box for holding the soda straws, and constructing the box using a first panel of the box and a first flap to define one side of the box. The first flap is hinged to an edge of the first panel of the box so that the first flap moves about a hinged edge of the first panel, whereby when the first flap is engaged with the first panel the first flap and the first panel form a closed side of the box, and when the flap is moved inside the box to a different position about the hinged edge an opening is formed in the side. The opening is formed in the side of the box, causing a second flap to move to a position so that articles in the box flow freely out of the box.

BRIEF DESCRIPTION OF THE DRAWINGS

Further features and advantages will become apparent from the following and more particular description of the preferred and other embodiments of the invention, as illustrated in the accompanying drawings in which like reference characters generally refer to the same parts, functions or elements throughout the views, and in which.

DETAILED DESCRIPTION OF THE INVENTION

Straw Dispenser

Figure 1:
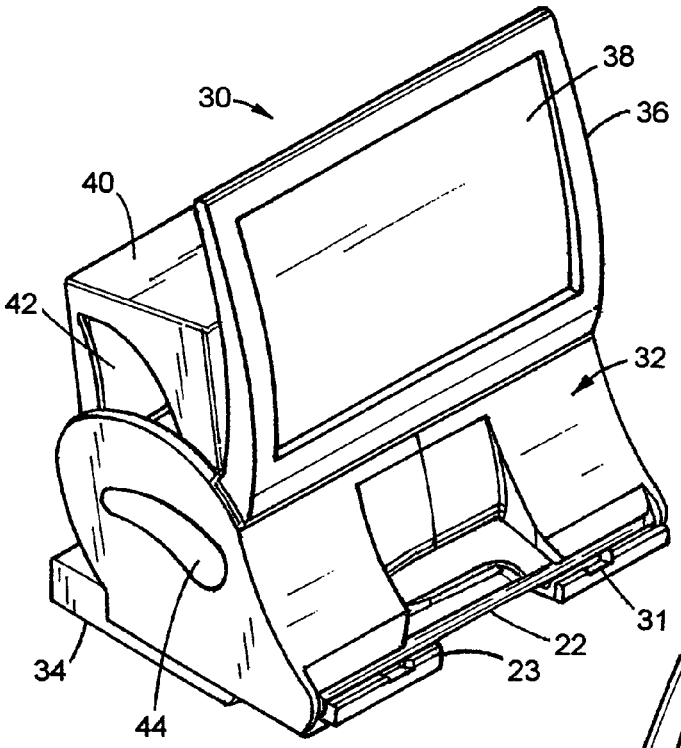
FIG. 1 is an isometric view of a soda straw dispenser according to one embodiment of the invention.

With reference to FIG. 1, there is shown a soda straw dispenser 30 adapted for use with an electrically operated mechanism for serializing and dispensing straws one at a time. The straw dispenser 30 is equipped with a base 32 to which a wall stand 34 can be attached. The wall stand 34 is constructed so as to be removably attached to the base 32, and attached to a vertical wall or the like, for fastening the straw dispenser 30 thereto. Alternatively, the soda straw dispenser 30 can be constructed for resting on a counter or table. The straw selector/dispenser mechanism (not shown) is removably fastened to the bottom portion of the base 32. An advertisement display 36 is removably attached to the base 32. The advertisement display 36 includes a window 38 through which one can view a paper or plastic advertisement sheet that is inserted between two opposed vertical channels formed on the backside of the advertisement display 36. A straw box 40 is insertable into a rectangular-shaped receptacle in the top of the base 32 and held therein so that straws in the box 40 can drop down into the base compartment 58, shown in FIG. 2. The straw box 40 has side windows 42 of clear plastic films to enable a person to see how many straws remain in the box 40. The base compartment 58 also includes one or two side windows 44 of a clear plastic for allowing a user to see how many straws remain in the base 32. A straw 22 is shown made available to the user. All of the components of the dispenser 30 can be constructed of a moldable ABS type of plastic, or other suitable material.

Figure 2:
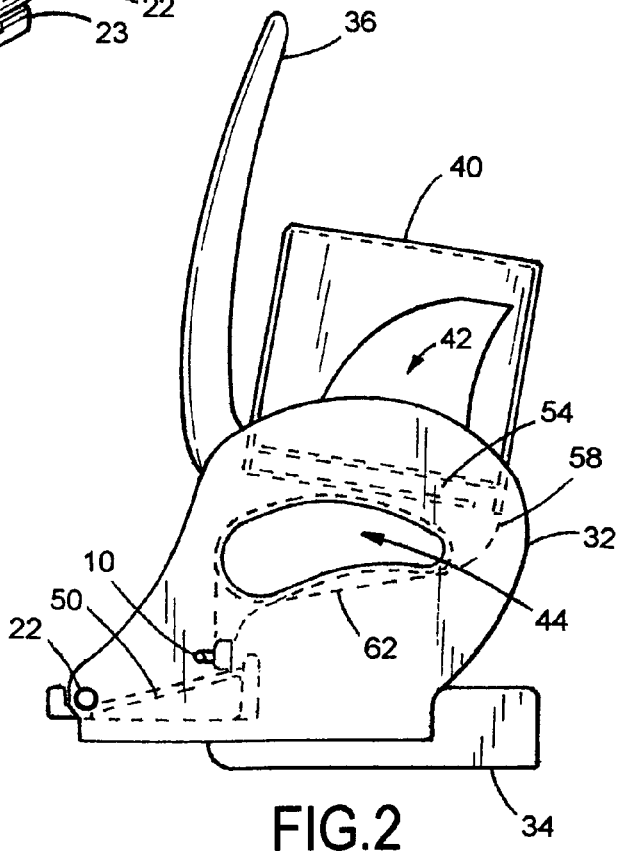
FIG. 2 is a side view of the soda straw dispenser showing various internal components in broken lines.

FIG. 2 illustrates further details of the straw dispenser 30. The straw box 40 is constructed with a band 54 along the bottom perimeter. The band 54 makes the straw box 40 somewhat larger in circumference so that it snugly fits within the receptacle 130 (FIG. 5*a*) formed in the top of the base 32. Once the straw box 40 is installed in the base 32, and opened, the straws can fall out of the box 40 and into the base compartment 58. The base compartment 58 includes a downwardly slanted floor 62 so that the straws migrate via gravity to the bottom front thereof and accumulate over the selector/dispenser mechanism 10.

Fixed to the frontal and bottom portion of the soda straw dispenser 30 is the selector/dispenser mechanism 10 for selecting one straw at a time and dispensing the straw when a proximity sensor senses that a user wants a straw. When a straw is dispensed from the selector/dispenser mechanism 10, it falls down on an inclined platform 50 and rolls to the front of the straw dispenser 30 and is made available to the user. The straw made available to the user is shown as numeral 22.

Figures 3A, 3B, 4A, 4B:
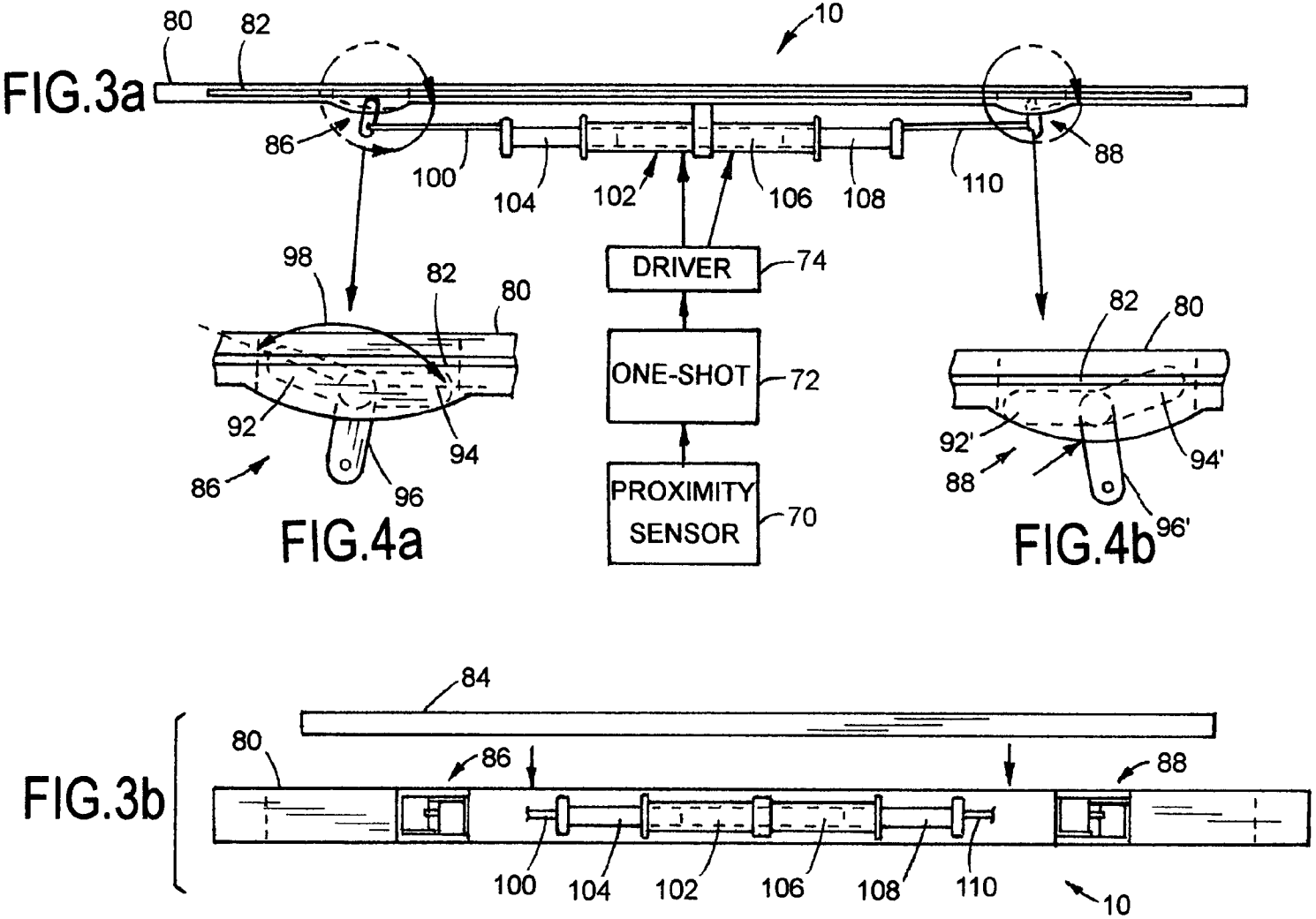
FIGS. 3*a*-3*c* are respective top, frontal and isometric views of an electrically-operated straw selector/dispenser according to one embodiment of the invention.
FIGS. 4*a*-4*b* are respective top views of the flippers of the selector/dispenser of FIGS. 3*a*-3*c* that serialize the straws for dispensing.
Figure 3C:
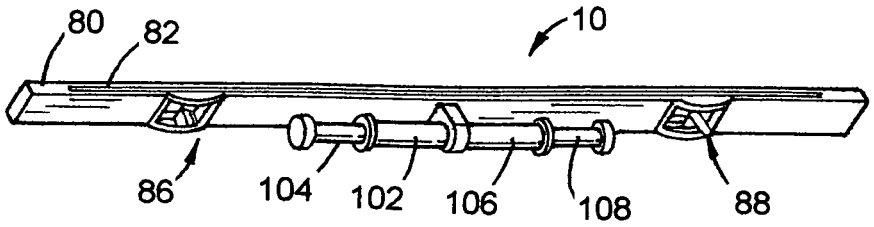

FIGS. 3*a*-3*c* illustrate a respective top view, frontal view and isometric view of the straw selector/dispenser mechanism 10 that is electrically operated. The selector/dispenser 10 includes an elongated straw receiver 80 having a slot 82 that extends from a top to a bottom of the straw receiver 80.

The slot 82 is of a sufficient size to allow only a single straw 84 to fall downwardly through the receiver 80. It can be appreciated that the straws 84 stored in the box 40 exit a bottom opening therein and roll down an inclined surface 62 and accumulate above the selector/dispenser 10. Before the straws 84 enter the selector/dispenser 10, they are serialized into a single vertical column of straws, one on top of the other. A vertical chute, or the like, can be used to funnel the straws into a serialized form from the inventory into a vertical stack or column of straws, one straw wide.

Figure 4C:
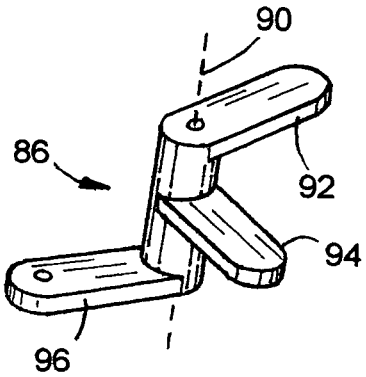
FIGS. 4*c*-4*d* are respective isometric and frontal views of one flipper according to the invention.
Figure 4D:
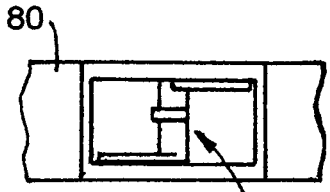

The selector/dispenser 10 can be employed in many different types of straw dispensers, other than described herein. Nevertheless, the straws are fed to the selector/dispenser 10 in serial form, but are controlled by the selector/dispenser 10 so as to individualize the straws 84 and feed them one at a time to an outlet so as to be made available to the user. A pair of flippers is employed, including a first flipper 86 and a second flipper 88. The first flipper 86 is constructed so as to be rotatable about an axis 90 (FIG. 4*c*). The flipper 86 can have a bore therethrough, or spindles fixed at each axial end of the flipper 86 so as to be rotatable about the axis 90. However, both flippers 86 and 88 need only rotate about twenty degrees.

The flippers 86 and 88 are constructed in an identical manner, of an ABS or other suitable plastic material. The flipper 86 is constructed with an upper wing 92 and a lower wing 94, which are separated vertically about the diameter of a soda straw. Accordingly, a soda straw can fit between the upper wing 92 and the lower wing 94. The upper wing 92 and the lower wing 94 are formed at an angle 98 shown in FIG. 4*a*. The flipper 86 is further constructed with a control arm 96 that is connected by a linkage 100 to a plunger 104 of an actuator 102, such as a solenoid. The body of the actuator 102 can be fastened to the body of the straw receiver 80. A second actuator 106 has a plunger 108 that is connected by linkage 110 to the control arm of the other flipper 88. A straw 84 to be dispensed is held between the upper and lower wings of both flippers 86 and 88. In order to dispense a straw 84, the actuators 102 and 106 are simultaneously energized and then de-energized in concert. Moreover, when it is desired to dispense a straw 84, the actuators 102 and 106 are energized so that the respective plungers 104 and 108 are withdrawn into the respective bodies of the actuators 102 and 106. The actuators 102 and 106 can be of the type where internal springs return the plungers 104 and 108 to the respective extended positions, as shown in the drawings. Other mechanical arrangements can be achieved so that a single actuator can move both flippers 86 and 88. Electrical devices other than solenoids can be utilized, including motors. A second sensor can be used to detect the presence of an available straw in the dispenser tray that has not been taken, to thereby prevent the dispensing of another straw when the presently dispensed straw has not been taken by a user.

The straw dispenser 30 is equipped with a sensor 70 that senses the presence of a person's hand that is ready to receive a straw. This is illustrated in FIG. 3*a*. The sensor 70 can be of an IR type that senses the heat of a person's hand, or of the type that breaks a beam of light. Other proximity sensors can be utilized with equal effectiveness. In any event, when the sensor 70 is activated, it generates an electrical signal that activates both actuators 102 and 106 for a predetermined period of time. The sensor 70 can trigger a one-shot multivibrator 72 to provide a specified period of time in which the actuators 102 and 106 are energized. A driver 74 can be employed to drive the coils of the solenoids 102 and 106. The actuators 102 and 106 are energized so that the respective plungers 104 and 108 are retracted within the bodies of the actuators 102 and 106. The linkages 100 and 110 are both moved toward the respective actuators 102 and 106, thereby rotating the flippers 86 and 88 in a short arc.

The individualizing of the straws 84 takes place in the following manner in the selector/dispenser 10. When the straws 84 are first loaded into the soda straw dispenser 30 via the straw box 40, they roll down an incline and into a chute and are thus serialized in a vertical column. The first flipper 86 is in its rest position where the upper wing 92 does not block the path of the slot 82, but the bottom wing 94 does block the path below the slot 82. The other flipper 88 is in the same state. The bottom straw 84 in the chute falls and is stopped by the bottom wings 94 and 94', whereupon the first straw to be dispensed next is supported on top surface of the bottom wings 94 and 94'. In this state, the lower wings 94 and 94' block the path of the straw 84 so that it does not fall down onto the slanted platform 50 of the dispenser 30. The subsequent straws can fall down on top of the bottom straw 84 that rests on the lower wings 94 and 94'. Nevertheless, the bottom straw 84 in the straw receiver 80 is then ready to be dispensed. The user of the straw dispenser 30 can then place his/her hand in front of the dispenser to trigger the sensor 70, whereupon the actuators 102 and 106 operate. The actuator plungers 104 and 108 pull on the control arms 96 and 96' to rotate the flippers 86 and 88. When rotated, the flippers 86 and 88 rotate the bottom wings 94 and 94' out of the path of the slot 82 so that the bottom straw 84 falls and rolls down the inclined platform 50 toward the user's hand. At the same time, the upper wings 92 and 92' are rotated into the path of the slot 82 to block the second straw from falling down with the first straw 84. Thus, at this transition time, the second straw rests on top of the upper wings 92 and 92'. After the first straw 84 has fallen down past the lower wings 94 and 94', the actuators 102 and 106 are de-energized so that the flippers 86 and 88 return to the rest positions. At this time, the upper wings 92 and 92' are moved out of the path of the slot 82 so that the second straw falls down onto the lower wings 94 and 94', which then again blocks the path under the slot 82 of the straw receiver 80. This state of the selector/dispenser 10 remains until another user desires to receive a straw, which would be the second straw that is now positioned between the upper wings 92 and 92' and the lower wings 94 and 94' of the respective flippers 86 and 88.

In the operation of the selector/dispenser 10, the upper and lower wings of the flippers 86 and 88 control the position of the straws so that they are individualized, and are dispensed one at a time, each time the sensor 70 is triggered. The wings are angled 98 on the respective flippers 86 and 88 so that before the bottom wing releases the straw to be dispensed downwardly, the upper wing is moving under the second overlying straw to block its path in the slot 82. As noted above, another sensor can sense the presence of a straw that is available to the user, and will prevent the dispensing of another straw onto the slanted platform 50 until the available straw is taken by a user.

While the preferred embodiment employs a pair of actuators 102 and 106, the selector/dispenser 10 could be constructed with a single actuator that operates both flippers 86 and 88. Moreover, the selector arrangement could be constructed using one or more wheels having indentions in the circumferential edges thereof, such as a sprocket wheel, for sequentially grasping straws and during rotation moving the straws from an upper position to a lower position until the bottom straw falls down and is dispensed. Another selector/dispenser arrangement can be of the type similar to a boat paddle wheel, where the wheel has straw-shaped cavities for accepting a straw in each cavity and when the wheel is turned to an outlet, a straw drops and becomes available to the user.

Other arrangements can be utilized to serialize the straws so that only a single straw is dispensed at a time. In accordance with a feature of the invention, the user of the straw dispenser 30 can only touch the straw that is dispensed and no other straws. Thus, the dispensing of the straws according the invention is not only more efficient and effective, but is less likely to pass germs and the like from one user to another user via the soda straws.

Three-Flap Straw Box

As described above, the soda straw dispenser 30 of FIG. 1 is well adapted for receiving a closed box 40 full of soda straws. Preferably, the box 40 of straws can be handled and installed in the dispenser 30 without touching the straws, thus preserving the cleanliness of the individual straws. An improved soda straw box 40 illustrated in FIGS. 5*a*-5*d* is constructed so as to be transported and installed in the dispenser 30 without having to touch any of the straws. The box 40 is illustrated with a number of straws therein, one shown as numeral 122. The straw box 40 is formed of a number of panels, and can be constructed of heavy paper, cardboard, or other suitable material. Preferably, the box 40 includes a top panel, bottom panel, front panel, rear panel and opposing side panels. Sections of the back panel 124 and the bottom panel 126 of the box 40 are shown in FIGS. 5*a*-5*c*. The bottom of the straw box 40 includes the bottom panel 126 together with a flap. The flap is moved out of the way during installation of the box 40 in the dispenser 30.

Figure 5D:
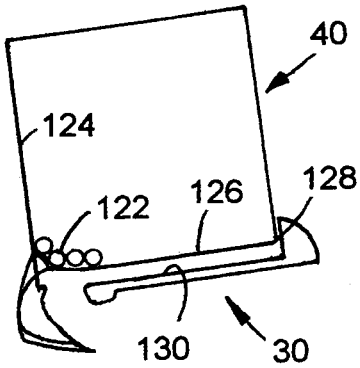
FIG. 5*d* is a side view illustrating the manner in which the straw box is engaged within a dispenser receptacle.
Figure 5C:
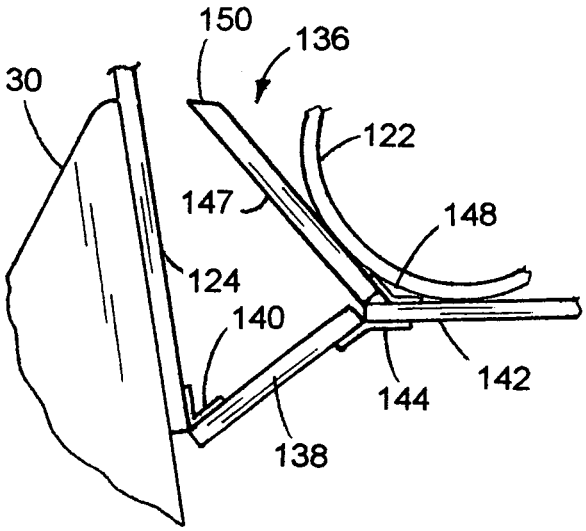
FIG. 5*c* is an enlarged side view of the hinged three-flap structure of the straw box.
Figure 5A:
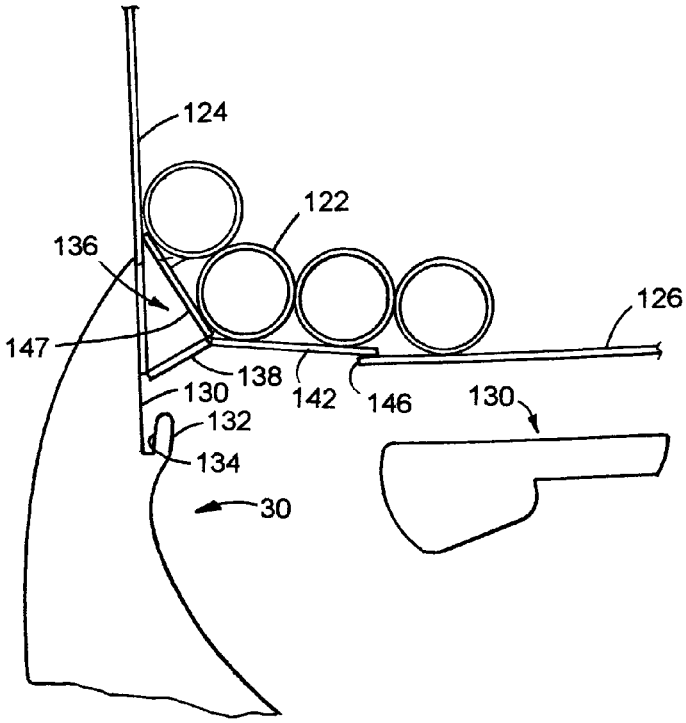
FIG. 5*a* is a side view of an embodiment of the soda straw box about to be engaged in a dispenser receptacle.
Figure 5B:
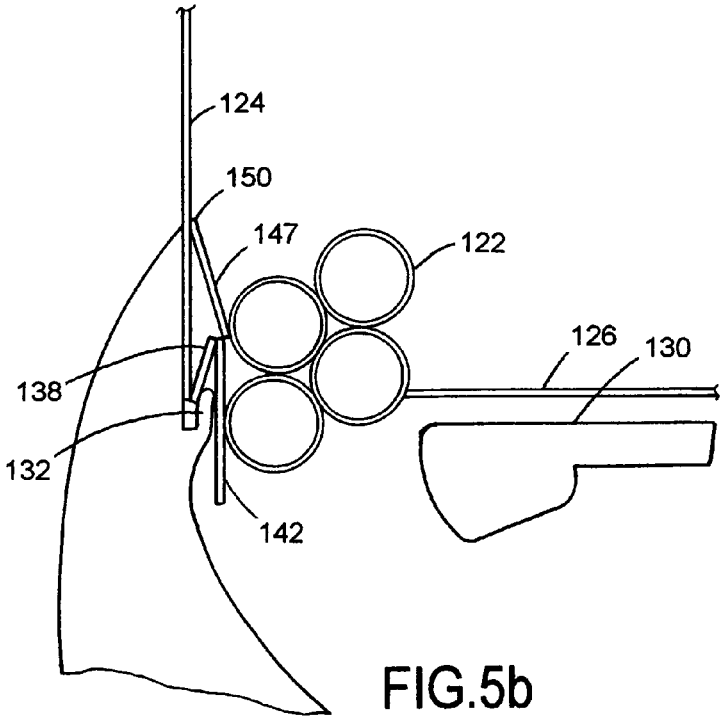
FIG. 5*b* is a side view of the soda straw box of FIG. 5*a* when fully installed in the dispenser receptacle.

The dispenser 30 is constructed with a receptacle 130 that has a footprint that is rectangular-shaped and has four upturned sides, one upturned side shown as numeral 128 in FIG. 5*d*. The bottom circumference of the straw box 40 thus fits snugly into the receptacle 130. The box 40 of straws is initially full of straws and is unopened when initially installed in the dispenser 30. The straw box 40 is installed by pushing it downwardly into the receptacle 130 of the dispenser 30. According to a feature of the invention, the installation of the straw box 40 into the dispenser receptacle 130 automatically opens the bottom 126 of the box 40 so that the straws 122 can be subsequently serialized, dispensed, and made available to the user, all without having to touch a straw.

The receptacle 130 of the dispenser 30 is constructed with a bottom and with upturned sides 128, as noted above. In one embodiment, the bottom of the receptacle 130 is slanted down at the back end thereof so that the box 40 is similarly slanted when installed therein. The back part of the receptacle 130 includes an elongated slotted opening member 132 that has an upturned part that is spaced from a back side of the receptacle 130. As will be described below, the slotted opening member 132 is effective to open a bottom portion of the box 40 during installation to allow the straws to roll out of the box 40 and into the dispenser 30.

The straw box 40 is fabricated with six sides or panels, with the bottom panel 126 having an opening formed therein during installation into the dispenser 30. In one embodiment, the box 40 is constructed with a three-part movable flap structure 136, shown in detail in FIG. 5*c* of the drawings. It should be understood that the movable flap structure 136 extends the entire length of the straw box 40 to thereby allow the straws 122 to fall therethrough lengthwise. Taped to the lower back panel 124 of the box 40 along the bottom corner is an anchor flap 138. The strip of tape is shown by numeral 140. The anchor flap 138 is thus anchored to the back panel 124 of the box 40 at the corner, but is hinged thereto by way of the flexible strip of tape 140. The anchor flap 138 is also taped to a cover flap 142, both of which are used to cover the bottom opening 146 in the box 40. As can be seen in FIG. 5*a*, the anchor flap 138, together with the cover flap 142, are effective to cover the entire bottom opening 146 of the box 40. The cover flap 142 is connected to the anchor flap 138 by a strip of tape 144 so that the two parts are hinged. Lastly, the cover flap 142 is taped to a support flap 147 along the elongated edges thereof with a strip of tape 148. This strip of tape 148 also functions as a hinge.

The box 40 can be constructed with a top panel (not shown) that can be opened or removed to fill the box 40 with straws. Usually, a predetermined number of straws are placed in each box 40. The top panel can then be closed and adhered to the box side panels so as to remain closed. As an alternative, the flap structure 136 and the bottom panel 126 can be made separate from the box 40 as a whole. The box 40 can then be turned upside down to fill it with straws at the factory, and then the bottom flap structure 136 and the bottom panel 126 glued to the side panels of the box 40. In this latter instance, the three-part flap structure 136 and the bottom panel 126 could be initially separate from the box 40, and then bonded thereto after the box 40 is filled with straws.

Once the box 40 is filled with straws at the factory, the edge 146 of the opening can be taped to the bottom surface of the cover flap 142. This ensures that during shipment and handling of the soda straw box 40, the three-part flap structure 136 will not be inadvertently opened. When the box 40 is ready to be installed in the dispenser 30, the tape can be removed so that the cover flap 142 can move with respect to the opening edge 146 of the bottom panel 126 of the box 40. Rather than using a removable tape, the elongated edge of the cover flap 142 can be bonded to the top surface of the box bottom panel 126 with an adhesive that breaks easily to release the cover flap 142 from the box bottom panel 126. Alternatively, the cover flap 142 can be made as part of the bottom panel 126 and perforated so as to be separable when it is desired to insert the box 40 into the dispenser 30.

As illustrated in FIG. 5*a*, the straw box 40 is being lowered down into the receptacle 130 of the dispenser 30. The straws 122 inside the box 40 are contained therein by the panels of the box 40, as well as the three-part flap structure 136. The angle between the anchor flap 138 and the cover flap 142 is less than or equal to about 180 degrees, and thus the weight of the straws is insufficient to bend the hinge tape 144 and allow the straws 122 to fall out of the box 40. As seen in FIG. 5*a*, the right-most edge of the cover flap 142 overlaps on top of the edge of the bottom opening 146 of the box 40. The support flap 147 prevents straws 122 from being lodged in the bottom corner of the three-part flap structure 136 and interfere with the movement of the flap structure 136 during installation of the box 40 into the dispenser 30.

The installation of the straw box 40 into the dispenser 30 is carried out as follows, and as illustrated in FIGS. 5*a* and 5*b*. An operator or other person responsible for the dispenser 30, lowers the box 40 full of straws and pushes it down into the receptacle 130. During lowering of the box 40 into the receptacle 130, the portion of the anchor flap 138 that is adjacent the corner first engages with the upturned member 132 of the base 32, whereupon the anchor flap 138 folds toward the back panel 124, as shown. The hinged edge of the anchor flap 138 becomes inserted and wedged into the slot 134 formed between the upturned member 132 and the back vertical side of the receptacle 130. As the opposite edge of the anchor flap 138 folds upwardly, the frontal edge of the cover flap 142 moves laterally past and clears the edge of the box opening 146. When the cover flap 142 moves past the edge of the opening 146 in the bottom of the box 40, it pivots down along the tape hinge 144 to allow the straws 122 to fall down through the opening 146 in the box 40. At the same time, the support flap 147 pivots and moves upwardly so that the free upper end 150 follows the vertical side surface of the back panel 124 of the box 40. Again, the support flap 147 prevents straws 122 from hanging up in the back of the box 40. Stated another way, the support flap 147 guides the straws in the back of the box 40 toward the bottom opening 146 and facilitates the free and easy movement of the straws 122 from the box 40 into the storage compartment of the dispenser 30.

The taped edges between the anchor flap 138 and the back panel 124 of the box 40 effectively form a fold that is wedged into the slot 134 between the upturned member 132 and the vertical back side of the receptacle 130. As such, this wedged relationship maintains the box 40 installed in the receptacle 130 and is not inadvertently dislodged therefrom. As can be appreciated, the downward tilt or slant of the box 40 within the slanted bottom of the receptacle 130 allows the box 40 to be emptied of straws 122 at the back corner opening 146. When empty, the box 40 can be removed from the dispenser 30 by simply grasping the opposite side panels of the box 40 and pulling upwardly. This can bend and distort the side panels of the box and dislodge the folded part of the flap structure 136 that was wedged in the slot 134 behind the upturned member 132, as well as dislodge the snug fit of the bottom perimeter of the box 40 within the upturned sides 128 of the rectangular-shaped receptacle 130.

Figure 6:
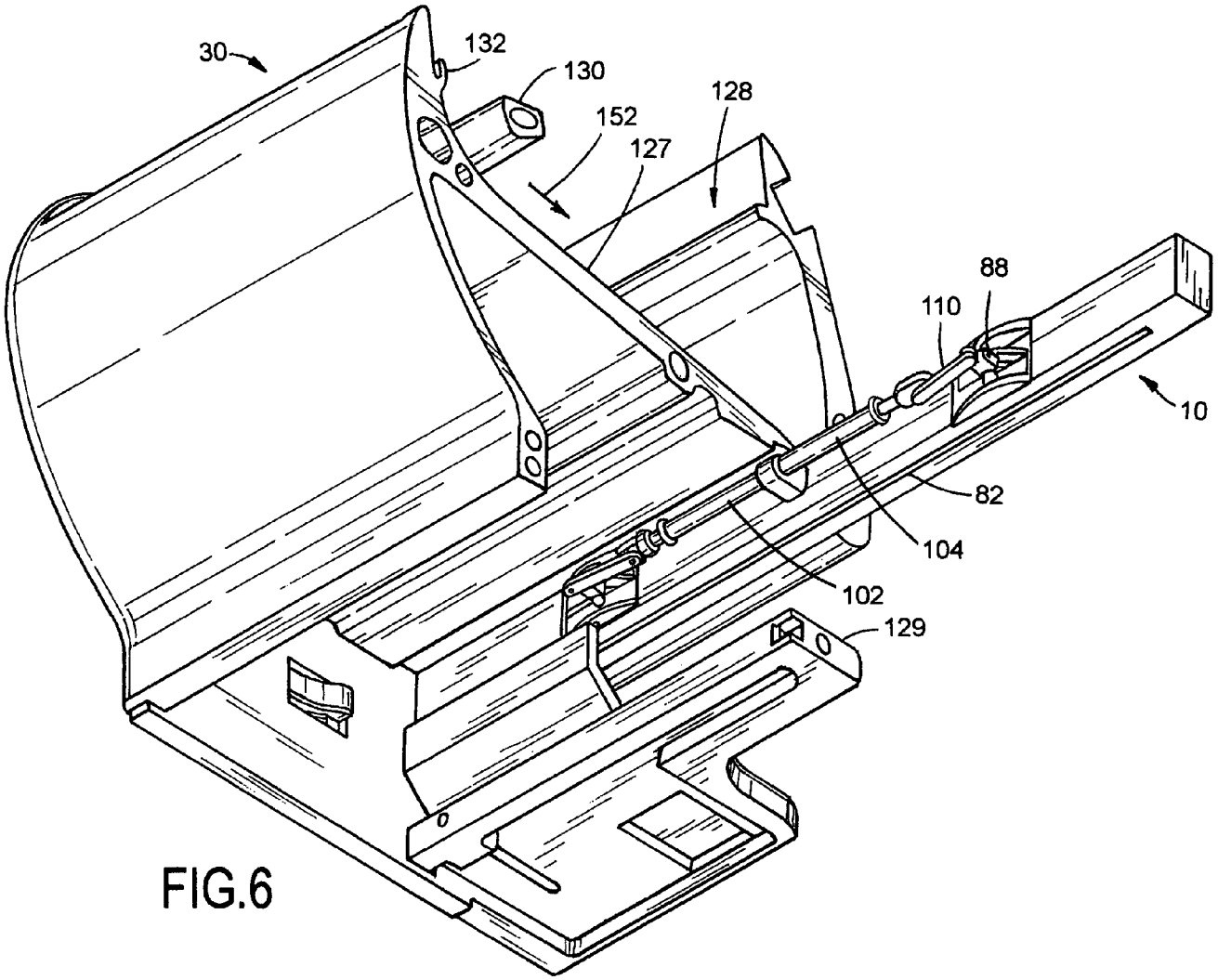
FIG. 6 is an isometric bottom view of the soda straw dispenser with the selector/dispenser located to receive straws that fall out of the opened straw box.

FIG. 6 illustrates the relationship of the selector/dispenser mechanism 10 with regard to the receptacle 130 of the dispenser 30. Once the straws 122 fall from the box 40, they roll forwardly down the slanted incline 127 in the direction of arrow 152 and accumulate over the selector/dispenser mechanism 10. The structure and operation of the flippers of the selector/dispenser mechanism 10 are described above. After the straws have been formed in a column in the slot 82 of the selector/dispenser mechanism 10 and then serialized, each individual straw falls down on an inclined platform 129 and rolls forward to be made available to the user, as shown in FIG. 1.

Figure 7A:
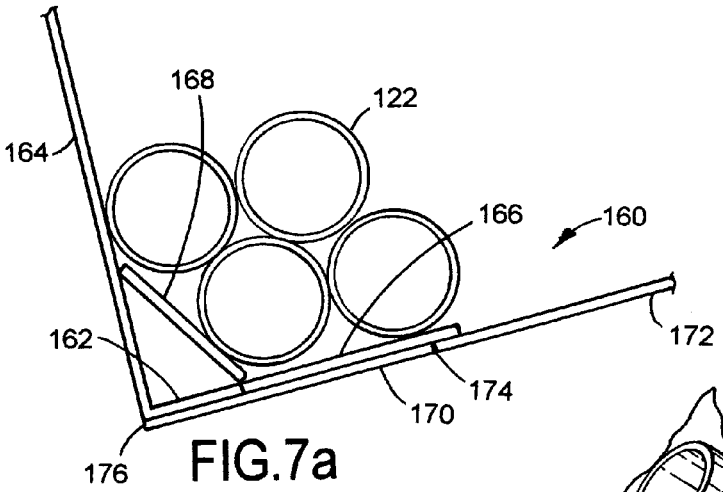
FIG. 7*a* illustrates a straw box that is closed and equipped with a removable bottom tape strip.
Figure 7D:
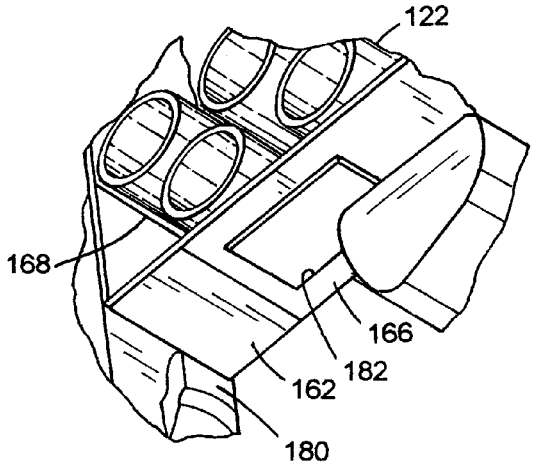
FIGS. 7*d* and 7*e* are enlarged views of multiple slotted opening members for holding the three-part flap structure in the opened condition.
Figure 7E:
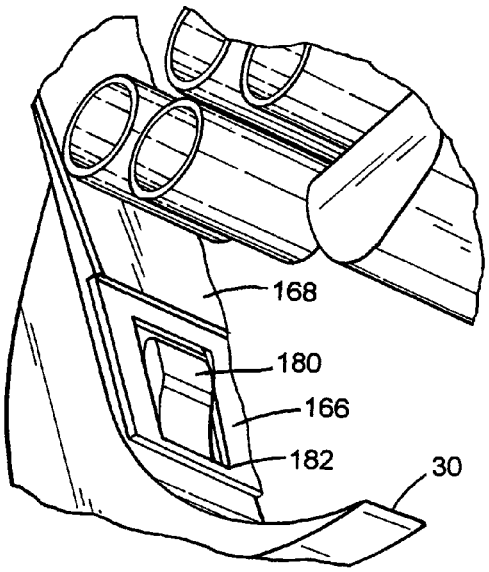
Figure 7B:
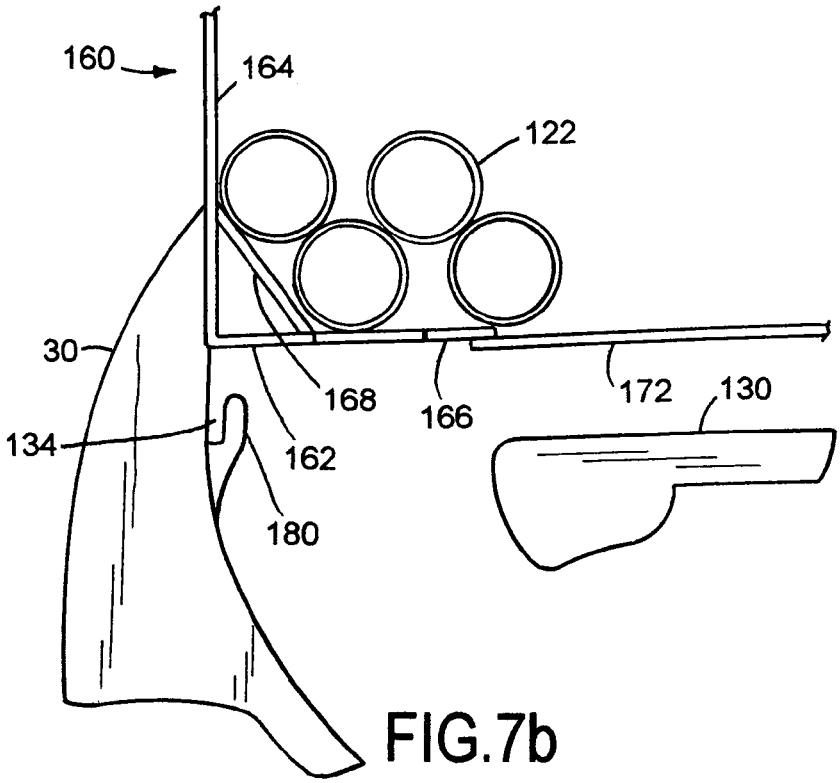
FIG. 7*b* illustrates the straw box of FIG. 7*a* with the tape strip removed and the box is ready to be installed in the straw dispenser.
Figure 7C:
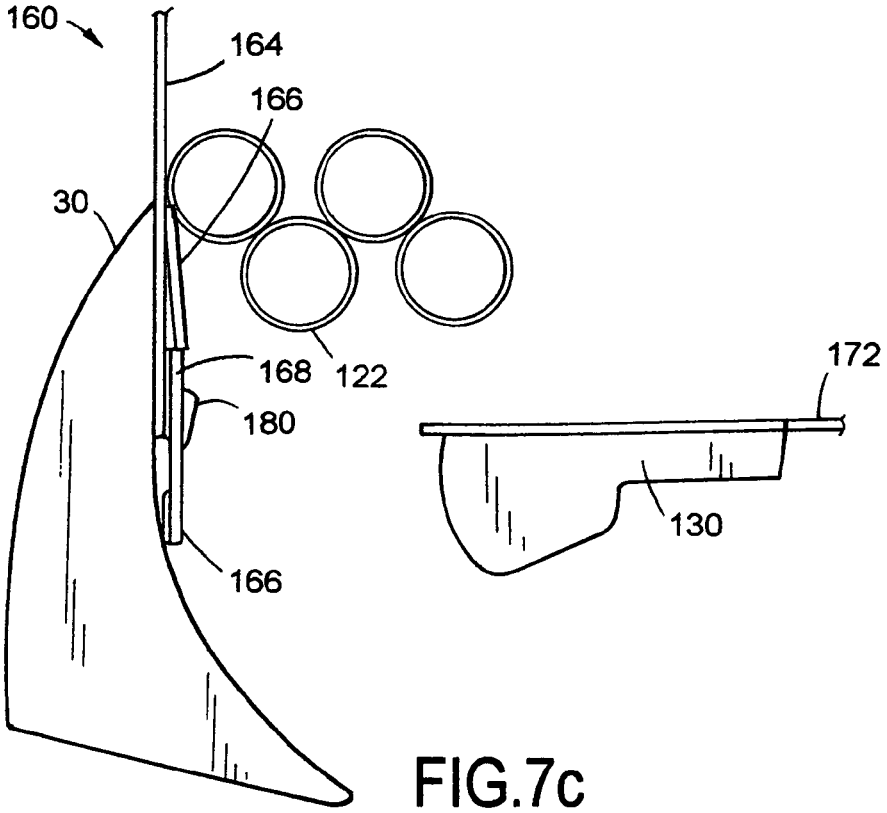
FIG. 7*c* illustrates the manner in which the three-part flap structure is folded and maintained in the opened condition by a slotted opening member.

FIGS. 7*a*-7*c* illustrate another embodiment of a straw box adapted for use in the dispenser of FIG. 1. In FIG. 7*a*, there is shown a sectional view of a straw box 160 holding a number of straws 122. The bottom panel 172 of the straw box 160 is constructed with an anchor flap 162 anchored to the back panel 164 of the box 160 by a strip of material that functions as a hinge to allow the anchor flap 162 to hinge or pivot counterclockwise. Attached to the anchor flap 162 by a similar hinge strip is a cover flap 166 that can pivot clockwise with respect to the anchor flap 162. Attached to the cover flap 166 by a similar hinge strip is a support flap 168 that pivots or hinges clockwise with respect to the cover flap 166. As can be seen, when the box 160 is shipped, a bottom slot or opening is covered by the anchor flap 162 as well as the cover flap 166. In addition, the bottom surfaces of the anchor flap 162 and the cover flap 166 can be covered by a tear strip or cover tape 170 that is removable when it is desired to install the box 160 into the dispenser 30. The tear strip 170 can be made of the same material as the bottom panel 172 of the box 160 and perforated along the edges 174 and 176. At least one end of the tear strip 170 is available to grasp by one's fingers and pull to tear the perforations 174 and 176 and remove the tear strip 170 from the bottom of the straw box 160.

According to a feature of the straw box 160, the cover flap 166 is constructed with one or more cutouts, one shown as numeral 182 in FIGS. 7*d* and 7*e*. FIG. 7*d* shows the cover flap 166 with cutout 182 prior to opening of the box 160, and FIG. 7*e* shows the relationship of the upturned part of the opening member 180 with the cutout 182 of the cover flap 166 after opening of the straw box 160. Each cutout 182 is associated with a slotted opening member 180 that is part of the dispenser receptacle 130. If the dispenser 30 is constructed with three slotted opening members 180, then the straw box 160 would be constructed with three cutouts 182 that are spaced apart in the same manner as the slotted opening members 180. As will be described below, an opening member 180 fits within a respective cutout 182 when the box 160 is fully installed in the dispenser 30. The slotted opening members 180 thereby maintain the flaps out of the way of the straws 122 dropping down from the box 160.

With reference to FIGS. 7*b* and 7*c*, there is illustrated the installation of the straw box 160 into the receptacle 130 of the dispenser 30. The perforated tear strip 170 has been removed from the bottom panel 172 of the box 160. As the box 160 is manually pushed down into the receptacle 130 of the dispenser 30, the upturned part of the slotted opening member 180 pushes up on the anchor flap 162. This causes the anchor flap 162 to pivot and fold counterclockwise at the bottom corner of the box 160, which moves the cover flap 166 to the left in the drawings so that the right edge of the cover flap 166 clears the edge of the bottom opening. At the same time the support flap 168 pivots clockwise somewhat and moves upwardly with its upper edge sliding along the inner wall surface of the back panel 164 of the box 160.

As the straw box 160 continues to be pushed downwardly, the bottom hinged edge of the folded anchor flap 162 becomes wedged in the slot 134 of each opening member 180, as shown in FIGS. 7*c* and 7*e*. During this action, the upturned members 180 protrude through the respective cutouts 182 formed in the cover flap 166. This is shown in FIG. 7*e*. With this arrangement, the various flaps are maintained against the back panel 164 of the box 160, and otherwise out of the way of the straws dropping down from the box 160.

Two-Flap Straw Box

Figure 8:
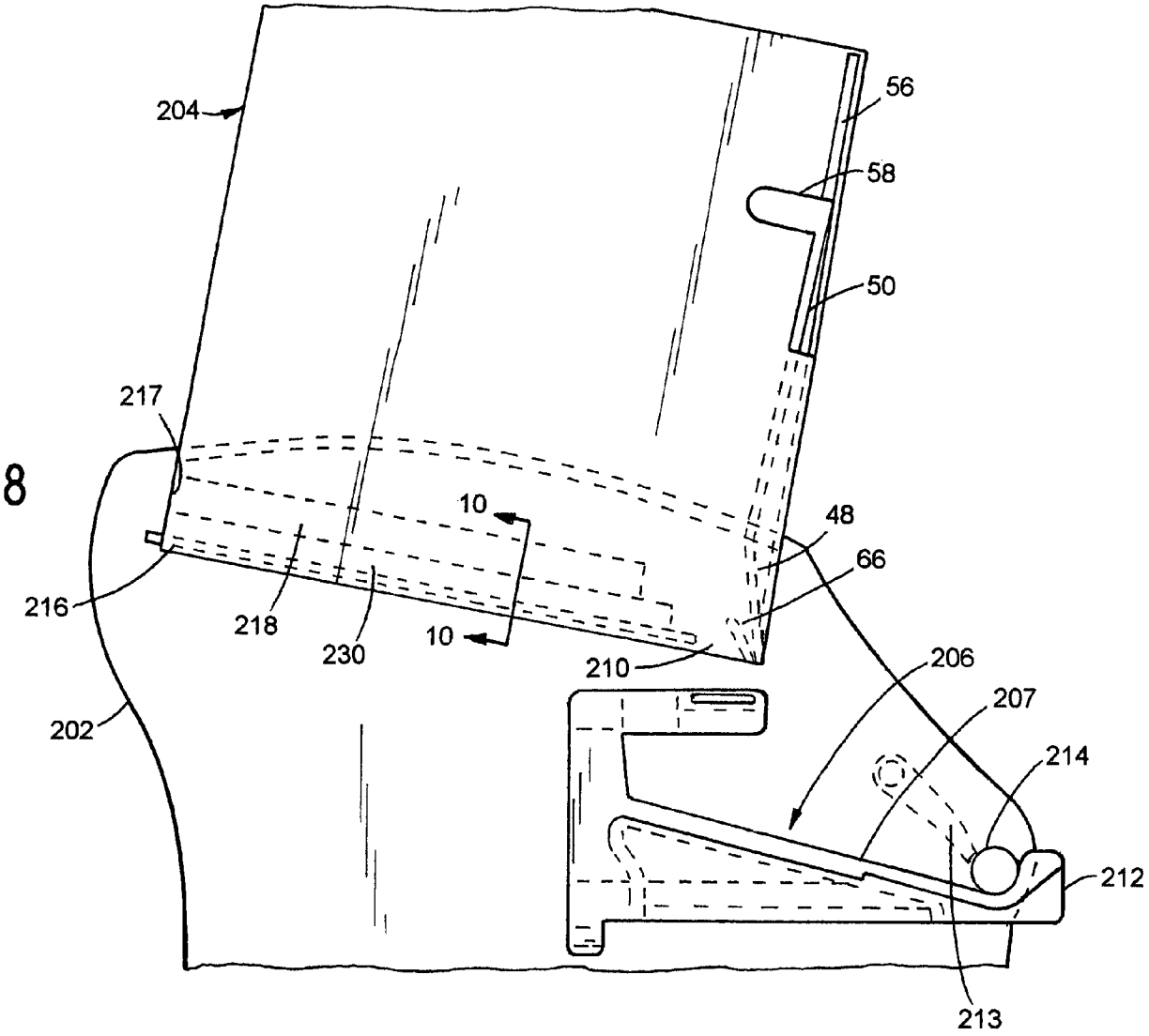
FIG. 8 is a side view of the straw dispenser of FIG. 8, with the straw box fully engaged therewith, and with the internal components shown in broken line.

With reference to FIG. 8, illustrated is a partial cross-sectional view of a soda straw dispenser 200 adapted for dispensing soda straws, one by one, to users. The straw dispensing apparatus includes a dispenser 202 having a body and internal mechanisms to dispense straws from a box 204 of straws. A part of the selector/dispenser mechanism 206 makes each straw individually available to a user. In practice, a central portion of a soda straw (shown in FIG. 1) is exposed so that a user can grasp the straw and remove it from the dispenser. The selector/dispenser 10 described above can be utilized. Other selector/dispensers can be employed with the dispenser 30 and the straw boxes disclosed herein. For example, the dispenser can be equipped with a selector/dispenser 206 of the type in which a slideable part is employed to slide toward the user so that the straw can be removed. During the forward movement of the slideable part of the dispenser, another straw is loaded from the box and will be made available to a subsequent user. The particulars of this slideable type of soda straw dispenser mechanism are described in detail in published PCT application WO 2012/162624. Other dispenser mechanisms can be employed for use with the various straw boxes disclosed herein.

As will be described below, the soda straw box 204 can be inserted into the dispenser 202 so that the bottom thereof is slanted to the front, as shown in FIG. 8. When installed into the dispenser receptacle, a door or flap in the bottom of the box 204 is automatically opened. In addition, when fully inserted into the dispenser 202, the box 204 is latched or otherwise attached to the dispenser 202 so that it cannot be easily removed. The soda straw box 204 is shown tilted toward the front for allowing the straws to fall out of the box 204 through the frontal bottom opening 210. The selector/dispenser 206 is located at the front of the dispenser receptacle to receive the straws that fall out of the box 204, serialize the same and allow each straw to be presented to the user via a slanted platform 207, or the like. Indeed, the receptacle for receiving the box 204 can be level, and the straw box 204 can be constructed with a false bottom that is slanted toward the bottom opening so that the straws migrate downwardly by gravity via the slanted false bottom of the box and toward the opening.

As noted above, the dispenser 202 includes a slideable type of selector/dispenser mechanism 206 for receiving soda straws from the straw box 204. In operation, straws drop out of a bottom opening 210 of the box 204 and collect above the selector/dispenser mechanism 206. When the slideable part 212 of the selector/dispenser mechanism 206 is pulled, together with the available straw 214, another straw is loaded from the collection of straws into the dispensing mechanism 206. This dispenser embodiment is of the type described in the above-referenced PCT published application. The slideable selector/dispenser mechanism 206 includes a brake 213 which engages behind the available straw 214 and prevents the slideable part 212 from retracting back into the dispenser and reloading another straw. The brake 213 is rotatable about an axle so that its rest position is as shown. The brake 213 can be weighted or be spring biased to maintain its rest position. When the soda straw is pulled forwardly, it brings with it the slideable part 212. When the straw is pulled past the brake 213, the brake momentarily lifts over the straw and then rotates clockwise to its rest position behind the straw. If the straw is not taken by the user, the brake is positioned behind the straw 214 and prevents the slideable part 212 from retracting. As such, more than one soda straw cannot be dispensed at a time without a user first taking the presently-dispensed straw. As noted above, other and different types of dispenser mechanisms can be employed with the box 204 with equal effectiveness. Like the other embodiments described above, the dispensing of the straws does not require a user to touch any of the straws, except the single straw that is available. In addition, the installation of the box 204 into the dispenser 202 does not necessitate touching of any of the straws.

Figure 10:
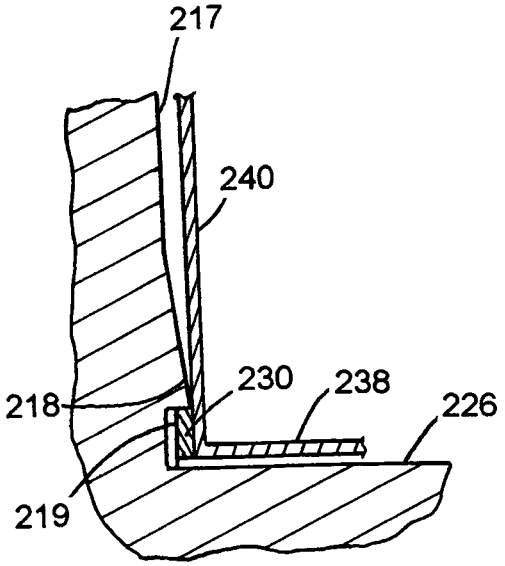
FIG. 10 is a partial cross-sectional view of the dispenser receptacle and the straw box, taken along line 10-10 of FIG. 8 showing the engagement therebetween to clamp the box to the dispenser receptacle.

The dispenser 202 is constructed with a floor 216 on which the box 204 rests when fully installed. The box receptacle 217 (also shown in FIG. 10) of the dispenser 202 is constructed with an inwardly slanted member 218 that has a bottom shoulder 219 under which the top edge of a band 230 is engaged. A similarly slanted member 218 is formed on opposite sides of the box receptacle 217. In other words, when the box 204 is pushed down into the receptacle 217 of the dispenser 202, the sides of the box 204 deform inwardly somewhat until the band 230 clears the bottom shoulders 217 of the opposing slanted members 218, whereupon the box 204 is latched or clamped into the dispenser 202 and cannot be inadvertently removed. The box 204, when empty of straws, can be grasped and forced out of the dispenser 202, out of engagement with the slanted members 218. During the removal procedure, the box 204 may be deformed or even destroyed.

Figure 9:
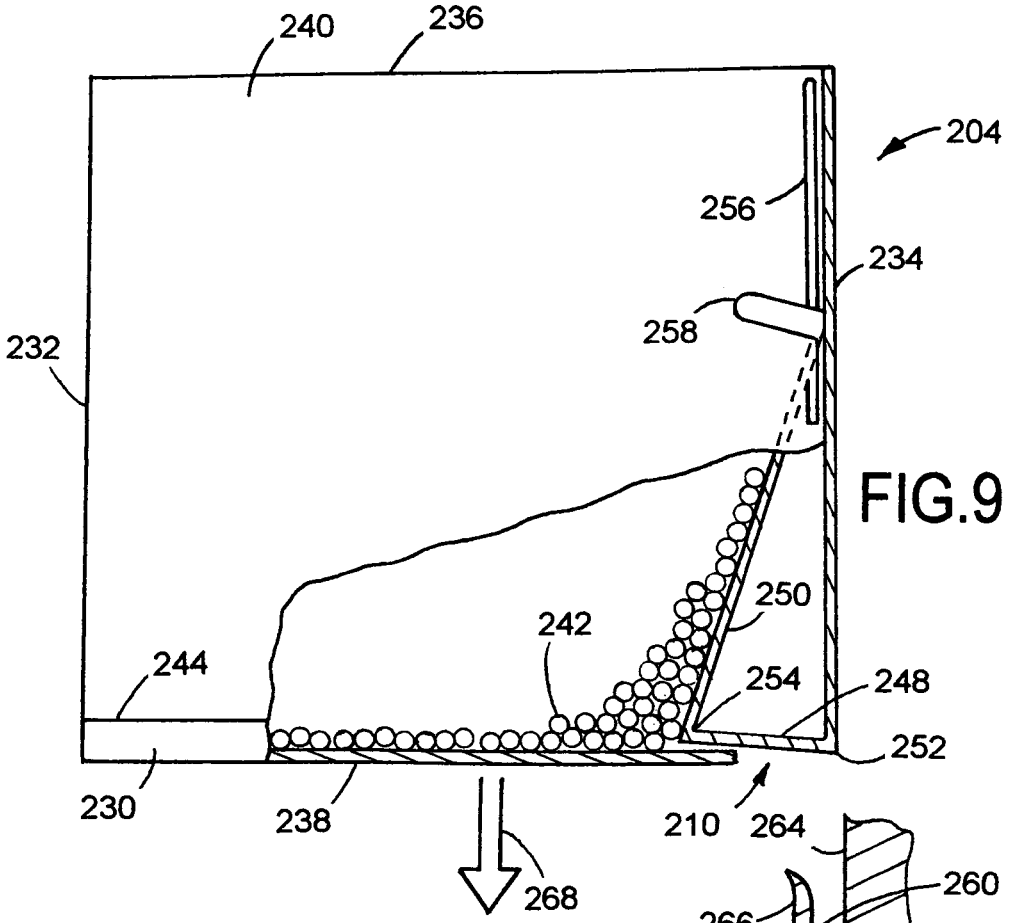
FIG. 9 is a partial cross-sectional side view of a straw box of another embodiment in the closed condition prior to engagement with the straw dispenser.
Figure 11:
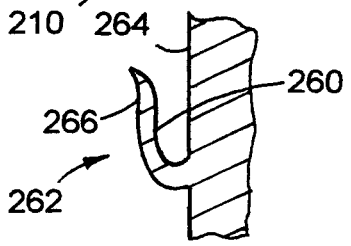
FIG. 11 is a partial cross-sectional view of the slotted opening member of the dispenser.

FIG. 9 illustrates the details of the straw box 204 according to this embodiment. The box 204 is constructed of cardboard or other generally rigid material. The box 204 includes a back panel 232, a front panel 234, a top panel 236, a bottom panel 238 and opposing lateral side panels, one shown as numeral 240. The top panel 236 can be opened (not shown) in order to fill the box 204 with straws 242, and then permanently closed and taped or adhered to the body of the box for shipment. The band 230 is attached to the lower part of the opposing side panels 240, and includes an upper edge 244 which is engaged under the corresponding bottom shoulder 219 of the slanted member 218. A continuous circumferential band can be employed, or only two band strips located on opposite sides as shown, or short band strips located around the circumference of the box 204.

The bottom panel 238 is a partial bottom with a portion that does not extend to the front panel 34 of the box 204. Rather, there is an opening 210 through which the straws 242 fall when the bottom of the box 204 is opened. The opening in the bottom front of the box 204 includes a two-part flap structure similar to the three-part flap structure described above, but without a cover flap. An anchor flap 248 of the two-part flap structure is formed as an extended portion of a bottom part of the front panel 34. In this embodiment, the anchor flap 248 fully covers the opening in the bottom of the box 204 when closed. The box 204 is thus closed and can be loaded with straws. The anchor flap 248 is sufficiently long that the edge thereof overlaps on the top of the bottom panel 238 of the box 204. The anchor flap 248 is connected via a folding edge 254 to a support flap 250. The support flap 250 is disposed upwardly inside the box 204 and angled forwardly towards the inside surface of the front panel 234 of the box 204. The box 204 is constructed so that the anchor flap 248 hinges to the front panel at folding edge 252, and the outer edge of the anchor flap 248 is hinged to the support flap 250 at folding edge 254. The hinges 252 and 254 can be either creases in the cardboard material, or tape. It should be understood that the anchor flap 248 extends all the way across the front bottom corner of the box 204, as does the cover flap 250.

The box 204 is further constructed with a vertical slot 256 on the opposing side panels 240. The vertical slots 256 are formed adjacent and parallel to the front panel 234 of the box 204. The length of the slot 256 extends from near the top of the box 204 to about more than half way down the opposing side panels 240. A tab 258 is attached to the top side edge of the cover flap 250, and extends outside the respective opposing side panel 240, via the slot 256. The opposite side edge of the cover flap 250 is similarly equipped with a tab 258 that extends through a corresponding slot 256 formed in the opposite side panel 240. By extending the tabs 258 through the respective slots 256, the top lateral edge of the cover flap 250 is maintained close and adjacent to the inside surface of the front panel 234 of the box 204. With this arrangement, the straws 242 inside the box 204 remain behind the cover flap 250 and cannot be lodged in front of the cover flap 50. As can be appreciated, as the cover flap 250 moves upwardly during opening of the anchor flap 248, the tabs 258 also move upwardly in the respective slots 256. When the anchor flap 248 is in the closed position, as shown in FIG. 9, the exposed portions of the tabs 258 can be removably attached to the respective side panels 240 of the box 204 with a suitable adhesive or tape. The removable attachment of the tabs 258 to the box 204 can be a mechanism for maintaining the anchor flap 248 closed during shipment. As an alternative, a removable paper strip (not shown) can be employed to temporarily fix the anchor flap 248 in the closed position. The paper strip can be removably attached to the bottom of the anchor flap 248 and to the adjacent portion of the bottom panel 238 of the box 204. When it is desired to install the box 204 in the dispenser 202, the paper strip can be manually removed and the box 204 pushed down in the receptacle 217 of the dispenser 202.

Referring now to FIGS. 9-12, the operation of the two-part flap structure of the straw box 204 will be described. The dispenser 202 is constructed with a floor 226 that is slanted downwardly toward the front of the dispenser 202. The floor 226 of the dispenser 202 terminates at the front thereof so as to form an elongate opening. Spaced from the frontal end of the floor 226 is an opening member 262. The opening member 262 is effective to open the anchor flap 248 of the box 204 when the box 204 is pushed down into the receptacle 217 of the dispenser 202. Much like that described above, the opening member 262 includes a planar back 264 for engaging with the lower surface of the box front panel 234. The opening member 262 is also constructed with an upturned part 266 that is spaced from the planar back 264 a distance of about twice the thickness of the sidewalls of the box 204. The space forms a slot 260 between the upturned part 266 and the planar back wall 264 that is sufficiently wide to accommodate the thickness of both the box front panel 234 and the thickness of the anchor flap 248. The opening member 262 extends all the way across the front of the dispenser receptacle 217, although this is not a necessity. The opening member 262 can be constructed was short individual opening members, similar to that illustrated in FIG. 7*e*, and spaced across the front of the bottom of the box receptacle 217.

When the box 204 is pushed down into the dispenser receptacle 217, as shown by arrow 268 in FIG. 9, the front lower corner of the box 204, where the folding edge 252 exists, is pushed down in the slot 260 of the opening member 262. The continued pushing of the box 204 into the receptacle 217 causes the upturned part 266 to force the anchor flap 248 to move or hinge clockwise about the folding edge 252, whereupon the anchor flap 248 begins to open and move away from the bottom panel 238 of the box 204. The clockwise movement of the anchor flap 248 inside the box 204, about the folding edge 252, causes the cover flap 250 to also move upwardly, as guided by the tabs 258 extending through the respective side slots 256. When the box 204 has been pushed all the way down into the receptacle 217, the lower part of the front panel 234 and the adjacent portion of the anchor flap 248 have fully entered the slot 260 of the opening member 262, as show in FIG. 12. In this position, the box 204 has been fully opened and the straws 242 can fall down and into the dispenser mechanism to be individualized and dispensed to the users.

Figure 12:
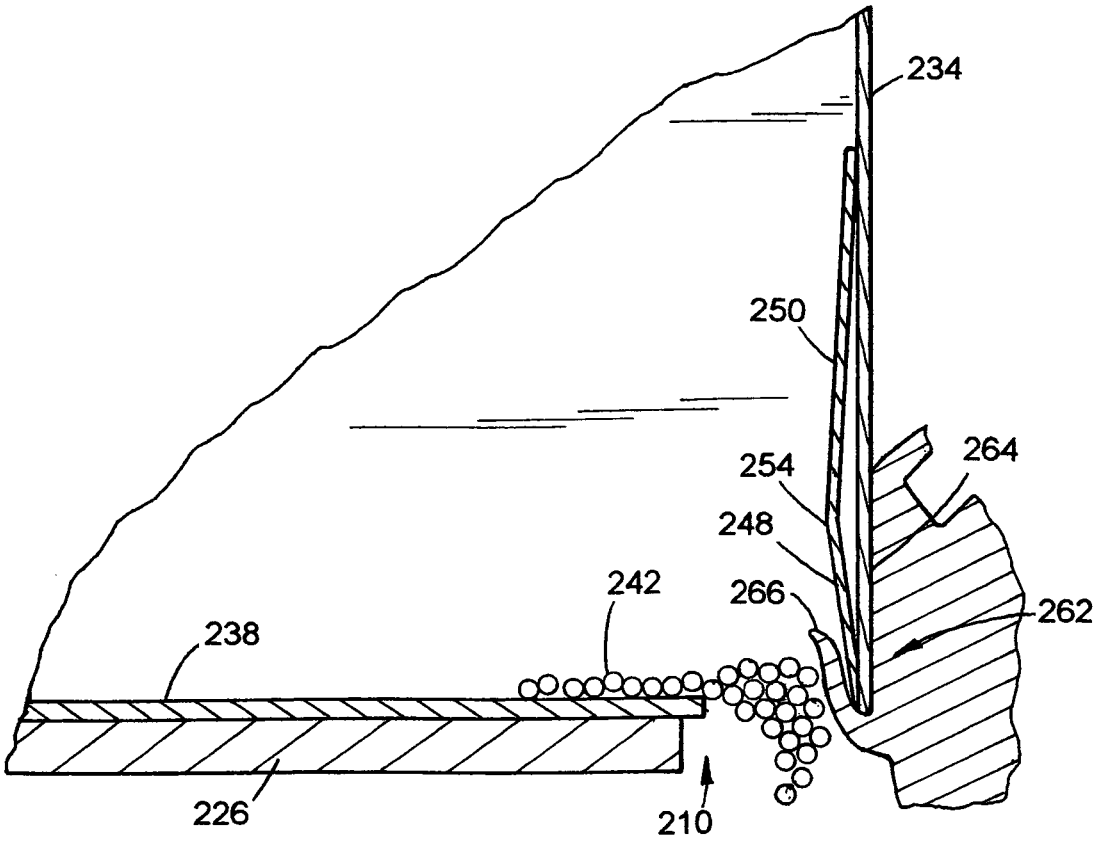
FIG. 12 is a partial cross-sectional view of the straw box fully inserted in the dispenser, where the slotted opening member has opened the bottom flap structure of the box.

As can be seen from FIG. 12, the anchor flap 248 and the cover flap 250 are removed from the opening in the box 204 and maintained in a position out of the way of the straws. In other words, the anchor flap 248 and the cover flap 250 do not impede the movement of the straws 242 as they fall out of the tilted box 204, nor does the flap structure cause straws to hang up in the box 204 so as to be unavailable to the dispenser 202.

From the foregoing, described are various embodiments of both straw dispensers and soda straw boxes. Those skilled in the art may find it advantageous to use various features of one embodiment in other embodiments. For example, the straw box can be employed in dispensers having receptacles that tilt to either the back or the front. The soda straw box of any of the embodiments can be employed in dispensers that utilize different selector/dispensers, including the electrical actuated selector/dispensers, slideable selector/dispensers, and others. The multi-flap structures can be constructed in boxes panels other than the bottom panel, as described above. The slot of the opening member can be constructed with shapes other than that described above. The slot need not be rectangular in shape, but can be constructed with other shapes, including V-shaped grooves, etc. The box can be constructed to hold elongated items other than straws, including pencils, etc.

While the preferred and other embodiments of the invention have been disclosed with reference to dispensers and boxes, and associated methods thereof, it is to be understood that many changes in detail may be made as a matter of engineering choices without departing from the spirit and scope of the invention, as defined by the appended claims.

What is claimed is:

1. A soda straw box, comprising:

a box for holding a plurality of soda straws, said box having first and second opposing side panels, each side panel of said opposing side panels terminating in a respective bottom edge, said box further including a bottom panel connected to the bottom edge of said first side panel, said bottom panel fixed during use of said box and not movable with respect to said first side panel, and said bottom panel does not extend to the bottom edge of said second side panel so as to provide an opening in the bottom of said box;

a flap structure adapted for covering the bottom opening in said box, said flap structure including a first flap hinged to a second flap; and said first flap having a first edge hinged along the bottom edge of said second side panel, said first flap further including a second edge parallel to said first edge that is hinged to said second flap, said first flap covering the bottom opening in said box when said box is closed, said first flap being laterally longer that a width of said bottom opening so that the second edge of said first flap overlaps onto an inside surface of said bottom panel when the bottom opening is closed, whereby the second edge of said first flap that is hinged to said second flap cannot move downwardly but can move upwardly into said box to uncover the bottom opening in said box and allow straws to move from said box.

2. The soda straw box of claim 1, wherein each flap of said flap structure is hinged to a neighbor flap with a folding hinge.

3. The soda straw box of claim 2, where each flap of said flap structure is hinged to a neighbor flap with a crease allowing at least two said flaps to be folded.

4. The soda straw box of claim 1, wherein said flap structure includes an anchor flap defined by said first flap, and said second flap defines a support flap, and further including a third flap hinged to said second flap, said third flap defining a cover flap.

5. The soda straw box of claim 1, wherein said second flap extends from a top surface of said bottom panel upwardly at an angle to engage an inside surface of said second side panel when said bottom opening is covered by said first flap.

6. The soda straw box of claim 5, wherein said second flap forms an acute angle with said first flap when said bottom opening is covered by said first flap, and as said flap structure is moved to uncover the bottom opening, the angle between said first and second flaps increases to more than 90 degrees.

7. The soda straw box of claim 1, further including in combination a straw dispenser having spaced apart members defining a channel for pressing therein the bottom edge of said second side panel and the first edge of said first flap when the box is pushed down into a receptacle of said dispenser.

8. The soda straw box of claim 1, wherein said box includes a side panel having at least one slot formed therein, and at least one said flap includes a tab that is inserted into said slot so that said slot guides said tabbed flap during movement thereof.

9. The soda straw box of claim 1, wherein said box includes a respective band members formed on at least two opposing side panels thereof, said band members for engaging with a dispenser receptacle to latch said box to the dispenser receptacle.

10. The soda straw box of claim 9, wherein said band members are formed on all four side panels of said box.

11. A soda straw box, comprising:

a box for holding a plurality of soda straws, said box having a plurality of panels forming an enclosure for the soda straws, a bottom panel of said box forming an opening through which the straws are dispensed;

an anchor flap adapted for covering at least a portion of the opening formed by the bottom panel of said box, said anchor flap hinged at a bottom edge of one said panel of said box;

a support flap hinged at one edge thereof to said anchor flap, said support flap angled at an acute angle with respect to said anchor flap when the opening formed by the bottom panel is covered by said anchor flap, and said support flap is located inside said box when the opening formed by the bottom panel is closed, said support flap having a free edge opposite the one edge hinged to said anchor flap, said free edge of said support flap freely movable upwardly inside said box during opening of said box; and said box is opened by moving said anchor flap inside said box, whereupon the angle between said anchor flap and said support flap increases beyond ninety degrees.

12. The soda straw box of claim 11, further including a slot formed in one said panel, and said support flap includes a tab extending through said slot so that said slot guides said tabbed support flap during movement thereof.

13. A method of forming a box for holding soda straws, comprising:

assembling plural panels to construct a six-sided box for holding the soda straws, assembling said box using a first upright panel hinged to a first flap where the hinge defines a bottom elongate corner edge of said box;

forming a bottom said panel on said box where said bottom panel has a first elongate edge forming a bottom elongate corner edge with a second upright panel that is parallel to said first upright panel, a second elongate edge of said bottom panel is opposite and parallel to the first elongate edge of said bottom panel, said second elongate edge of said bottom panel is spaced from the first elongate corner edge to define an opening in said box;

forming a second flap hinged at a folding edge to said first flap, and folding said second flap along said folding edge inside said box so that said second flap forms an acute angle with said first flap, and extending the folding edge of said first flap so as to overlap onto the second elongate edge of said bottom panel; and a bottom portion of said first upright panel, said first flap and said second flap form a right triangle when the opening in said box is closed.

14. The method of claim 13, further including forming an elongated slot in an upright panel of said box.

15. The method of claim 14, further including inserting a tab attached to said second flap through said slot.

16. The method of claim 15, further including using the slot to guide movement of said second flap during opening of said box, where the angle between said first flap and said second flap increases.

17. The method of claim 15, further including guiding a top edge of said second flap along an inside surface of said first upright panel using at least one said tab attached to a top portion of said second flap.

18. The soda straw box of claim 11, further including in combination a straw dispenser having spaced apart members defining a channel for pressing therein a box corner where said anchor flap is hinged at an edge thereof to one said panel of said box when the box is pushed down into a receptacle of said dispenser.

19. The method of claim 13, further including in combination a straw dispenser having spaced apart members defining a channel for pressing therein the bottom elongate corner edge of said box when the box is pushed down into a receptacle of said dispenser.

20. A soda straw box, comprising:

a box for holding a plurality of soda straws, said box having plural side panels with respective bottom edges;

a flap structure adapted for covering an opening in a bottom of said box, said flap structure including a first flap hinged to a second flap;

said first flap having a first edge hinged along the bottom edge of one said side panel, said first flap further including a second edge parallel to the first edge thereof, said first flap covering the bottom opening in said box when said box is closed;

said second flap located inside said box and angled at an acute angle with respect to said first flap when said box is closed, and when the box is pushed into a receptacle of a straw dispenser, said flap structure is constructed to move into the box to uncover the opening and allow straws to move from the box to the dispenser; and one said side panel of said box having at least one slot formed therein, and at least one said flap includes a tab that is inserted into said slot so that said slot guides said tabbed flap during movement thereof.

* * * * *